US006497439B1

(12) United States Patent
Guo

(10) Patent No.: US 6,497,439 B1
(45) Date of Patent: Dec. 24, 2002

(54) SNOW SHOVEL HAVING LIGHT WEIGHT AND GREATER STRENGTH

(76) Inventor: Wen Li Guo, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/000,165

(22) Filed: Dec. 4, 2001

(51) Int. Cl.[7] ..... E01H 5/02
(52) U.S. Cl. ..... 294/54.5; 294/56
(58) Field of Search ..... 294/49, 54.5, 56; 15/257.9; 37/265, 285

(56) References Cited

U.S. PATENT DOCUMENTS 252,822 A * 1/1882 Way ..... 15/236.01
813,166 A * 2/1906 Newton ..... 294/54.5
1,062,474 A * 5/1913 Kelly ..... 294/54.5
1,176,112 A * 3/1916 Volkstadt ..... 294/54.5
1,475,899 A * 11/1923 Thibault et al. ..... 294/49

* cited by examiner

*Primary Examiner*—Dean J. Kramer

(57) ABSTRACT

A shovel includes a base panel portion, a shovel member secured on the base panel, a handle secured to the shovel member, and a blade secured to the bottom and front portion of the base panel and extended forward beyond the base panel for engaging with material such as the snow. The shovel member and the base panel may be made of lighter metal or plastic or composite materials, for decreasing the weight of the shovel and for reducing the manufacturing cost for the shovel. The blade is made of stronger metal materials for increasing the working life of the shovel.

3 Claims, 3 Drawing Sheets

SNOW SHOVEL HAVING LIGHT WEIGHT AND GREATER STRENGTH

BACKGROUND OF THE INVENTION

1. Field of the Invention

The present invention relates to a shovel, and more particularly to a snow shovel having a lighter weight and having an increased strength.

2. Description of the Prior Art

Some of the typical shovels, particularly the snow shovels are made of metal materials and include an excellent strength. However, the typical metal shovels include a heavy weight that the users may not easily operate, or that the users may not operate for a long time. In addition, the typical metal shovels include an expensive manufacturing cost.

The other typical snow shovels are made of plastic materials and include a light weight. However, the typical plastic shovels include a weak or less strength that the shovels may be easily broken after use.

The present invention has arisen to mitigate and/or obviate the afore-described disadvantages of the conventional snow shovels.

SUMMARY OF THE INVENTION

The primary objective of the present invention is to provide a shovel including a lighter weight for allowing the shovel to be easily operated by the users and including an increased strength for increasing the working life of the shovel.

In accordance with one aspect of the invention, there is provided a shovel comprising a base panel including an upper portion, and a bottom and front portion, a shovel body secured on the upper portion of the base panel, a handle secured to the shovel body, and a blade secured to the bottom and front portion of the base panel and extended forward beyond the base panel for engaging with an object. The shovel body may be made of stronger but lighter metal materials for decreasing the weight of the shovel. The base panel may be made of lighter metal materials or plastic or composite materials, for decreasing the weight of the shovel and for reducing the manufacturing cost for the shovel. The blade is made of stronger metal materials for increasing the working life of the shovel.

The shovel body includes at least one opening formed therein, the base panel includes at least one bulge extended therefrom and engaged into the opening of the shovel body.

The shovel body includes a bar, a beam, and at least one arm secured between the bar and the beam. The base panel includes a plurality of depressions formed therein for receiving the bar and the beam and the arm of the shovel body.

The shovel body includes a plurality of ribs extended from the bar and the arm for reinforcing the bar and the arm.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
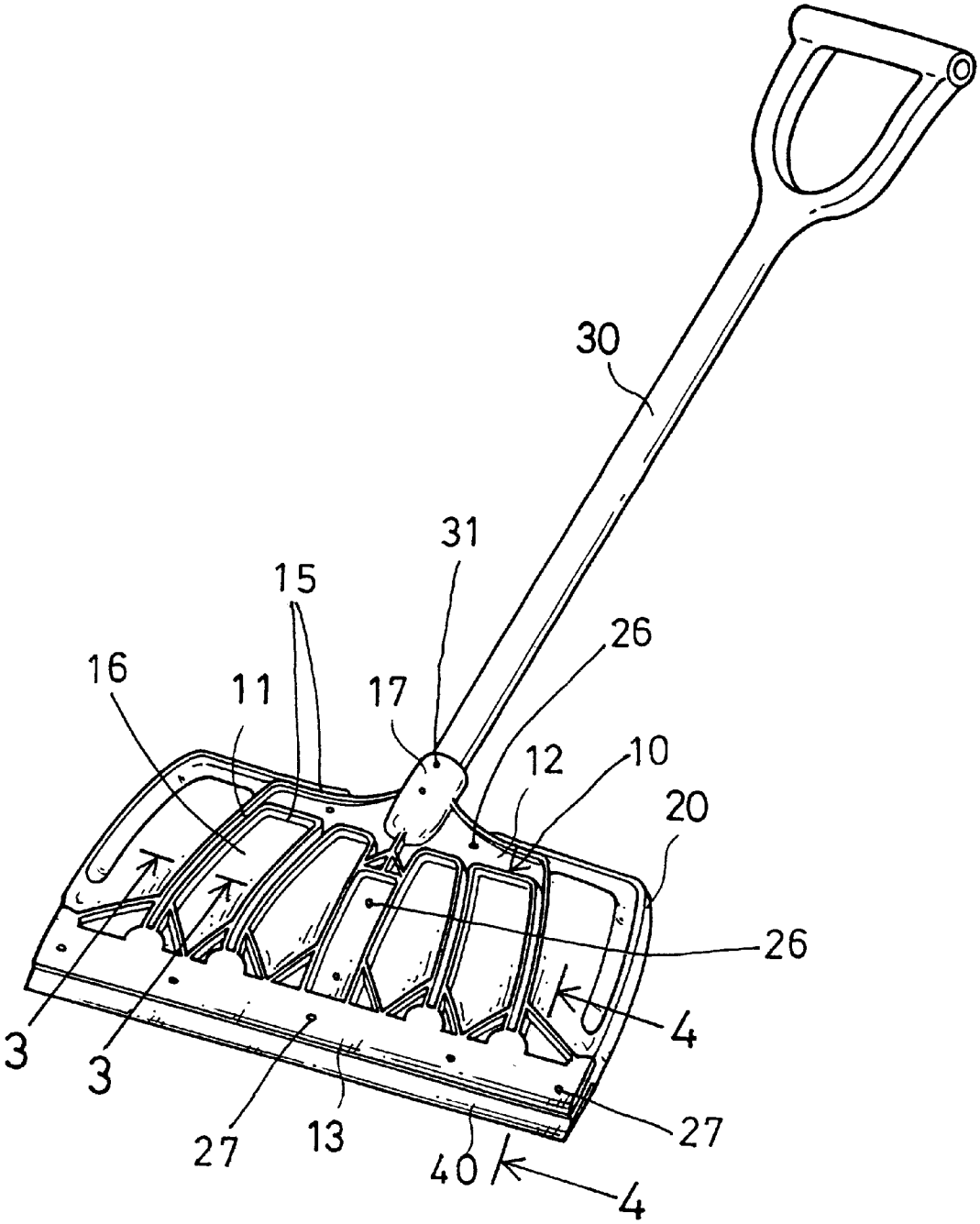
FIG. 1 is a perspective view of a shovel in accordance with the present invention.
Figure 2:
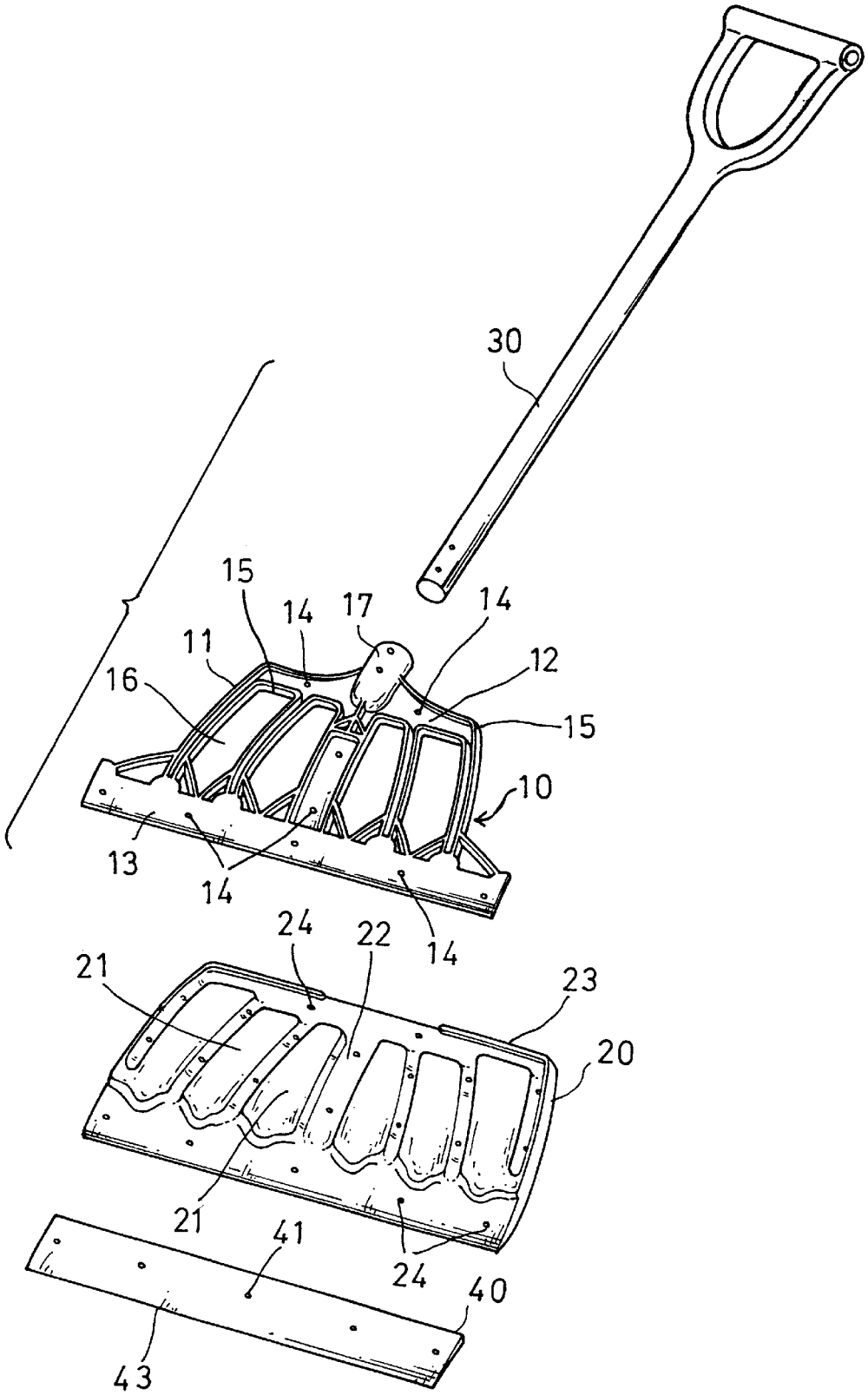
FIG. 2 is an exploded view of the shovel.
Figure 3:
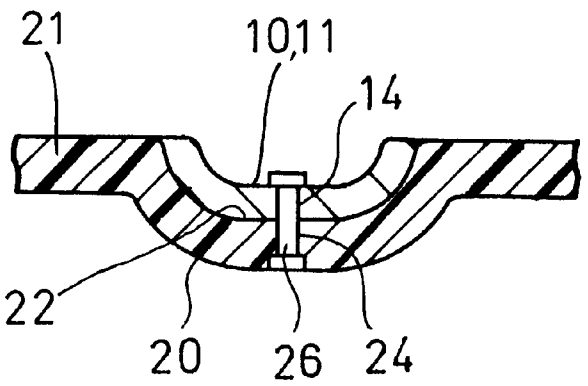
FIGS. 3 and 4 are partial cross sectional views taken along lines 3—3 and 4—4 of FIG. 1 respectively.

Referring to the drawings, and initially to FIGS. 1–3, a shovel in accordance with the present invention may be a snow shovel and comprises a shovel body 10 including one or more arms 11 extended or formed or provided between a bar 12 and a beam 13, and including a number of holes 14 formed in the arms 11 and/or the bar 12 and/or the beam 13, and including one or more openings 16 formed between the arms 11 and the bar 12 and the beam 13, for such as the weight reducing purposes. The shovel body 10 includes a number of ribs 15 formed or extended from the arms 11 and/or the bar 12 and/or the beam 13, and preferably extended upward or perpendicular to the arms 11 and/or the bar 12 and/or the beam 13, for reinforcing purposes. The shovel body 10 is preferably made of stronger but light weight metal materials, such as aluminum and the alloys thereof, for decreasing the weight of the shovel. The shovel body 10 includes a socket 17 formed or provided on the bar 12. A handle 30 includes one end engaged into and secured to the socket 17 with such as the fasteners 31 (FIG. 1).

The shovel further includes a base panel 20 having one or more bulges 21 extended upward therefrom corresponding to the openings 16 of the shovel body 10, for engaging into the openings 16 of the shovel body 10, and for securing to the shovel body 10 with such as a force-fitted engagement. Relatively, the base panel 20 includes one or more depressions 22 formed or defined in the upper portion thereof and formed or defined by the bulges 21 and/or one or more fences 23, for receiving the bar 12 and/or the arms 11 and/or the beam 13 of the shovel body 10. The base panel 20 is preferably made of stronger but light weight metal materials such as aluminum and the alloys thereof, or plastic materials, composite materials, etc., for decreasing the weight of the shovel, and for reducing the manufacturing cost for the shovel. The base panel 20 includes a number of holes 24 formed therein and aligned with the holes 14 of the shovel body 10. A number of fasteners 26 may be engaged through the holes 14, 24 of the shovel body 10 and the base panel 20, for securing the bar 12 and/or the arms 11 of the shovel body 10 to the base panel 20.

Figure 4:
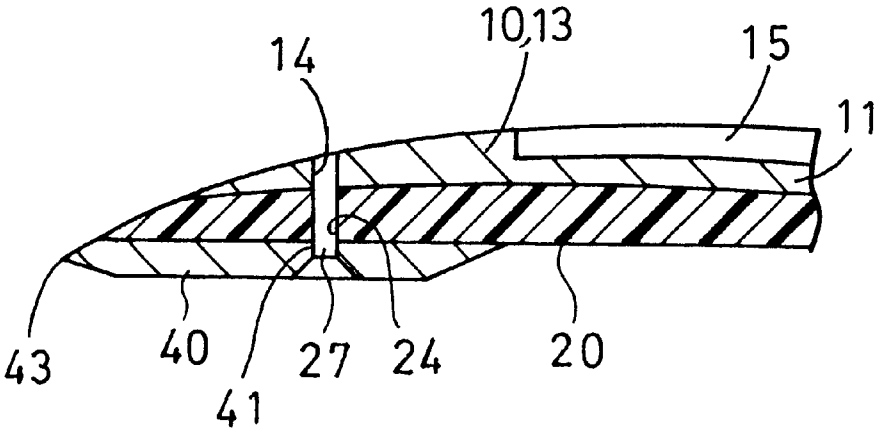

Referring next to FIG. 4 and again to FIGS. 1 and 2, a blade 40 is further provided and is preferably made of stronger metal materials, such as steel, or the other stronger materials, and is secured to the bottom of the base panel 20 with fasteners 27 which are engaged through the holes 24, 41 of the base panel 20 and the blade 40. The blade 41 has a free edge or a front edge extended outward beyond the base panel 20, and/or the shovel body 10, for engaging with the object, such as the snow to be shoveled, and for increasing the working life of the shovel. As best shown in FIG. 4, the blade 40 includes a sharp front edge 43 for easily engaging into the snow. The blade 40 and the base panel 20 and the shovel body 10 preferably includes a rounded or smooth upper and front surface for easily engaging into the snow.

It is to be noted that the blade 40 may be made of stronger but lighter metal materials, for increasing the working life of the shovel. The shovel body 10 and the base panel 20 may be made of lighter materials for decreasing the weight of the shovel and for allowing the shovel to be easily operated and to be operated with a long time by the users.

Accordingly, the shovel in accordance with the present invention includes a lighter weight for allowing the shovel to be easily operated by the users and including an increased strength for increasing the working life of the shovel.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shovel comprising:

a base panel including an upper portion, and a bottom and front portion, said base panel including a plurality of depressions formed therein, a shovel body secured on said upper portion of said base panel, said shovel body including a bar, a beam, and at least one arm secured between said bar and said beam, said bar and said beam and said at least one arm of said shovel body being received in said depressions of said base panel respectively, a handle secured to said shovel body, and a blade secured to said bottom and front portion of said base panel and extended forward beyond said base panel for engaging with an object.

2. The shovel according to claim 1, wherein said shovel body includes at least one opening formed therein, said base panel includes at least one bulge extended therefrom and engaged into said at least one opening of said shovel body.

3. A shovel comprising:

a base panel including an upper portion, and a bottom and front portion, shovel body secured on said upper portion of said base panel, said shovel body including a bar, a beam, and at least one arm secured between said bar and said beam, said shovel body including a plurality of ribs extended from said bar and said at least one arm for reinforcing said bar and said at least one arm, a handle secured to said shovel body, and a blade secured to said bottom and front portion of said base panel and extended forward beyond said base panel for engaging with an object.

* * * * *